US011235373B2

(12) United States Patent
Zaffaroni

(10) Patent No.: US 11,235,373 B2
(45) Date of Patent: Feb. 1, 2022

(54) DETACHING APPARATUS FOR THE AUTOMATIC DRAWING OF SHEETS FROM A STACK OF SHEETS

(71) Applicant: ASTES4 SA, Balerna (CH)

(72) Inventor: Roberto Zaffaroni, Balerna (CH)

(73) Assignee: ASTES4 SA, Balerna (CH)

( * ) Notice: Subject to any disclaimer, the term of this patent is extended or adjusted under 35 U.S.C. 154(b) by 0 days.

(21) Appl. No.: 16/797,752

(22) Filed: Feb. 21, 2020

(65) Prior Publication Data

US 2020/0269305 A1 Aug. 27, 2020

(30) Foreign Application Priority Data

Feb. 22, 2019 (IT) ..... 102019000002573

(51) Int. Cl.

| | |
|---|---|
| ***B65H 3/08*** | (2006.01) |
| ***B21D 43/18*** | (2006.01) |
| ***B21D 43/02*** | (2006.01) |
| ***B21D 43/11*** | (2006.01) |
| ***B65H 3/02*** | (2006.01) |

(Continued)

(52) U.S. Cl.

CPC ..... *B21D 43/18* (2013.01); *B21D 43/026* (2013.01); *B21D 43/11* (2013.01); *B65H 3/02* (2013.01); *B65H 3/08* (2013.01); *B65H 3/48* (2013.01); *B65H 7/12* (2013.01); *B65H 7/16* (2013.01); *B65H 2301/42324* (2013.01);

(Continued)

(58) Field of Classification Search

CPC ..... B21D 43/18; B21D 43/026; B21D 43/11; B65H 3/02; B65H 3/08; B65H 3/48; B65H 3/0816; B65H 3/0833

See application file for complete search history.

(56) References Cited

U.S. PATENT DOCUMENTS 2,140,023 A * 12/1938 McElroy ..... B65H 1/18 271/31
2,156,648 A * 5/1939 Baker ..... B65H 3/0816 271/31

(Continued)

FOREIGN PATENT DOCUMENTS

DE 3136544 A1 3/1983
DE 3312459 A1 10/1984

(Continued)

OTHER PUBLICATIONS

IT Search Report, dated Nov. 20, 2019, from corresponding IT application No. 102019000002573.

*Primary Examiner* — Thomas A Morrison
(74) *Attorney, Agent, or Firm* — Nixon & Vanderhye

(57) ABSTRACT

A detaching method of sheets from a stack of sheets from a stack of sheets and a relative detaching apparatus is disclosed, including at least a gripping head of a handling device of sheets and a nozzle assembly apt to eject an air flow to a lateral edge of a stack of sheets, furthermore including: a storage assembly of pressurised air provided at least with a compressed-air tank equipped with a pressure multiplier and a relative first pressure adjuster; and a high-pressure pipe between the nozzle assembly and the storage assembly intercepted by a fast-opening electrovalve. The nozzle assembly is provided with a nozzle, supplied through the electrovalve, configured as a convergent/divergent spout.

3 Claims, 5 Drawing Sheets

(51) Int. Cl.
*B65H 3/48* (2006.01)
*B65H 7/12* (2006.01)
*B65H 7/16* (2006.01)

(52) U.S. Cl.
CPC .... *B65H 2406/122* (2013.01); *B65H 2406/13* (2013.01); *B65H 2701/173* (2013.01)

(56) References Cited

U.S. PATENT DOCUMENTS

| | | | | | |
|---|---|---|---|---|---|
| 4,469,218 | A * | 9/1984 | Cosse | B65G 47/71 | 193/45 |
| 5,092,578 | A | 3/1992 | Bergmeier et al. | | |
| 5,372,290 | A * | 12/1994 | Marmin | B41F 33/18 | 101/228 |
| 6,345,818 | B1 * | 2/2002 | Stephan | B25J 15/0616 | 271/91 |
| 8,858,411 | B2 | 10/2014 | Mossi | | |
| 2015/0343999 | A1 * | 12/2015 | Lopez Galera | B60S 1/481 | 134/30 |

FOREIGN PATENT DOCUMENTS

| | | | |
|---|---|---|---|
| DE | 4339839 | A1 | 5/1995 |
| DE | 102008044111 | A1 | 6/2010 |
| EP | 0453835 | A2 | 10/1991 |
| KR | 2004-0034821 | A | 4/2004 |
| WO | 2008/139409 | A2 | 11/2008 |

* cited by examiner

DETACHING APPARATUS FOR THE AUTOMATIC DRAWING OF SHEETS FROM A STACK OF SHEETS

FIELD OF THE INVENTION

The present invention relates to the field of the sheet handling in cutting plants. In particular, the invention refers to an improved detaching apparatus for the automatic drawing of metal sheets.

STATE OF THE PRIOR ART

In the field of metal sheet processing, in particular in automatic cutting and sorting stations, a growing attention exists towards the optimisation of automation and of the process variables, to achieve ever increasingly controlled, orderly and efficient productivity.

In particular, the handling and sorting arrangements must guarantee a high degree of efficiency and of sturdiness, also for the purpose of limiting idle processing times, which are both undesired and harmful, since—despite having a cost equal to that of production times—they do not give added value, but rather cause a dramatic loss of flexibility and, hence, of potential throughput of the processing lines.

As known, in the cutting operations of plates/sheets the need exists of transferring and handling said sheets between one processing station and the other. In particular, the plates/sheets (be they metal ones or made of other materials) are arranged, at the start of a processing line, in stacks of multiple pieces lying on top of one another, as they come from warehouses.

The sheets must hence be drawn one at a time from the stack to be transferred to the processing stations, for example an operative table of a 2D cutting machine (which employs, for example, $CO_2$ lasers, fibre lasers, plasma or water jet cutting). For such purpose, loading/unloading systems are used which comprise handling arms (pneumatic, magnetic, equipped with gripping devices and so on . . . ) suitable to draw, transfer and release the sheets in the desired positions. Particularly effective and advantageous handling arms are the ones described, for example, in WO2008/139409 in the same Applicant's name.

As efficient the handling equipment may be, during the drawing step some problems often arise, especially when the sheets are large and heavy. As a matter of fact, the stacked sheets tend to adhere to one another due to the vacuum conditions which occur between the plate surfaces due to pressure in the surface contact areas. Moreover, such effect is enhanced by the casual presence of condensation water or of lubricating/preserving liquids.

Therefore, the drawing operations of a single, fresh sheet from the top of the stack can occur irregularly, for example resulting in the lifting of two or more sheets at one time (which then detach irregularly, taking up positions which then prevent regular automatic operation) or even resulting in the impossibility of lifting anything when the force applied by the handling arms is not sufficient to overcome the adhesion forces between the top sheet in the stack and the ones lying underneath.

It is clearly understood that the simultaneous removal of multiple sheets, the misalignments of the underlying sheets, manual corrections in fully automatic processes, drops of sheets and resulting damages, lead to unacceptable processing delays or, in the worst cases, undesired impacts against objects or people.

A traditionally employed system for separating sheets in a stack provides the use of an airflow directed at the separation region between two sheets. An example of this technology is disclosed in DE102008044111, which relates to a detachment nozzle for a stack of paper sheets in a printing machine of security sheets.

This technology per se, as can be guessed, works well with lightweight sheets such as paper security sheets, but it is not effective with heavyweight metal sheets. Nevertheless, air-jet detaching equipment has been proposed also for metal sheets, as described in DE4339839 and DE3136544. Despite their simplicity, these solutions have however found little application at an industrial level, because they were not really effective.

EP0453835 describes a further compressed-air detaching apparatus which, however, has a remarkable complexity, with a plurality of oriented nozzles, to be able to achieve the desired effectiveness.

Therefore, these prior art solutions, despite representing a first solution attempt to the drawbacks mentioned above, do not prove fully satisfactory, because they do not allow to obtain a reliable detachment of the metal sheets each other or they have an excessively complex configuration which is inapplicable to metal sheets of varying size.

It should be noted furthermore that the use of compressed air line coming from a classic air delivering facility—as they are typically available in industrial environments—represents an obstacle for the movements of the machine and requires bulky safety shielding if it is meant to operate at high pressure.

The need is therefore felt to supply an improved air-operated detaching apparatus, which is capable of increasing the effectiveness of the detaching action between sheets, which does not necessarily require long distribution lines of high-pressure air and which has limited bulk and costs.

SUMMARY OF THE INVENTION

The objects reported above, according to the present invention, are achieved through an improved blow detaching apparatus, for the detachment of sheets in a stack, having the features defined in claim 1. Other preferred features of the detaching apparatus are defined in the dependent claims.

BRIEF DESCRIPTION OF THE DRAWINGS

Further features and advantages of the invention will in any case be more evident from the following detailed description of a preferred embodiment of the same, provided purely as a non-limiting example and illustrated in the attached drawings, wherein.

DETAILED DESCRIPTION OF THE PREFERRED EMBODIMENT

Figure 6:
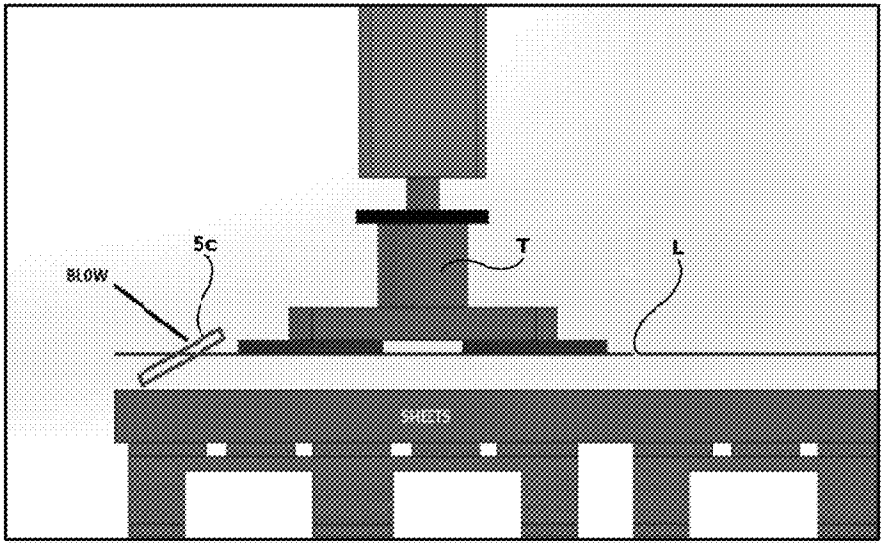
FIG. 6 is a schematic elevation side view which represents the relative arrangement of the blowing nozzle with respect to an handling head in a sheet raising step.

In a drawing area of stacked metal sheets, a sheet detachment apparatus is provided in cooperation with a sheet handling device (shown only partly in FIG. 6).

Figure 1:
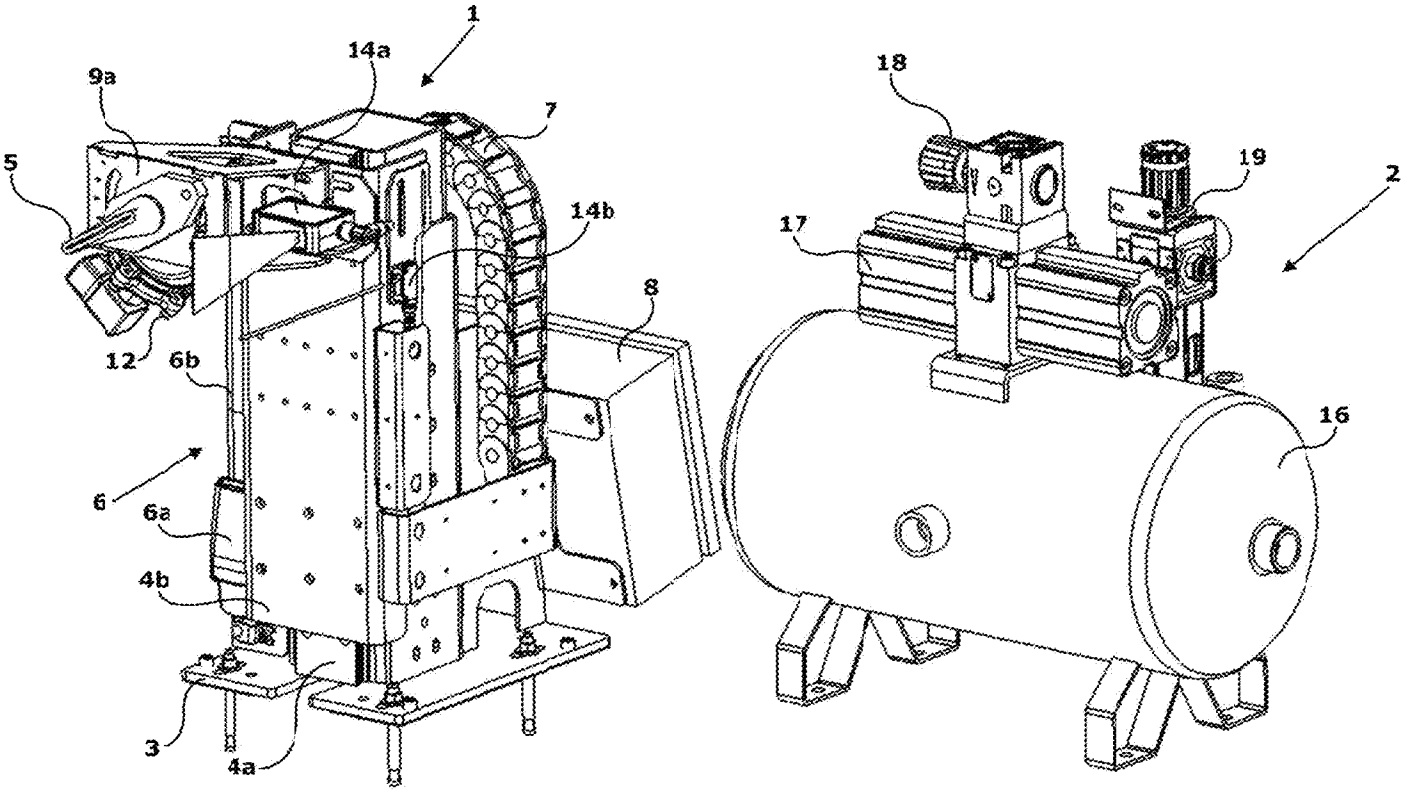
FIGS. 1 and 2 are views in two opposite perspectives of an improved blow detaching apparatus according to a preferred embodiment of the invention.
Figure 2:
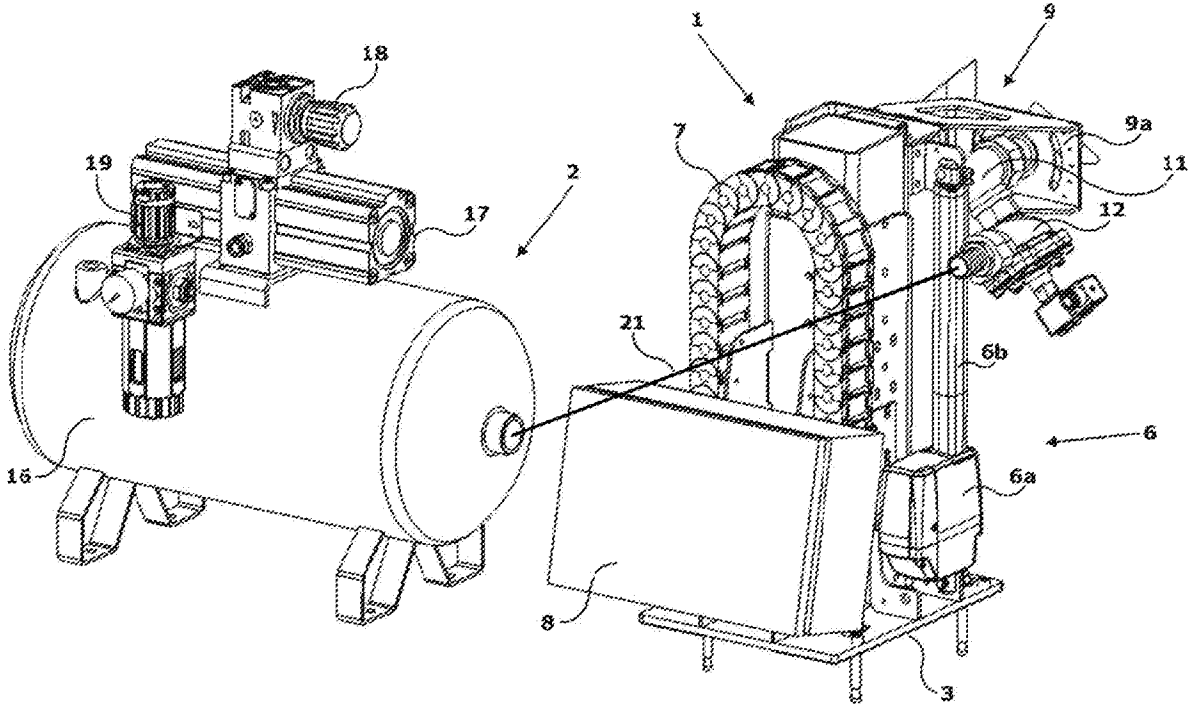

The detaching apparatus is in the shape of an air-operated detaching apparatus—clearly illustrated in FIGS. 1 and 2—suitable to direct an air flow onto the lateral side of a stack of metal sheets, precisely at the gap between overlapping metal sheets.

According to the invention, the detaching apparatus comprises a nozzle assembly 1 and a storage assembly 2 of pressurised air.

Nozzle assembly 1 comprises a support basis 3—fastened to the ground in the illustrated embodiment—installed next to the drawing area of the metal sheet stack, whereon a nozzle unit is installed. Said unit consists of a height-adjustable support 4, at the top of which a nozzle 5 is installed with the relative control accessories.

Support 4 preferably consists of a fixed post 4*a*, provided with sliding guides 4*a*', whereon a moving column 4*b* is mounted vertically slidable. The nozzle 5 is integral with the moving column 4*b*.

Moving column 4*b* is slidingly controlled in a vertical direction through a linear driver 6, preferably consisting of an electric motor 6*a* which causes the extension of a rod 6*b* constrained, with one end, to the moving column 4*b*. On one side of support 4—for example on the rear side in FIG. 1—a wire-guiding assembly 7 is provided, within which electric lead wires are arranged to provide electric supply to the top of the moving column 4*b*, in particular to supply electric current to the accessories of the nozzle unit.

Wire-guiding assembly 7 is connected, in the lower part, to a control panel 8.

Preferably nozzle 5 is mounted on an adjustment plate 9*a* of a support bracket 9 integral with the top of the moving column 4*b*. Adjustment plate 9*a* is arranged with a substantially vertical attitude and has in the middle a circular hole (not shown), through which a connection conduit 5*a* of nozzle 5 runs, as well as semicircular eyelets 9*b* are provided.

Figure 5:
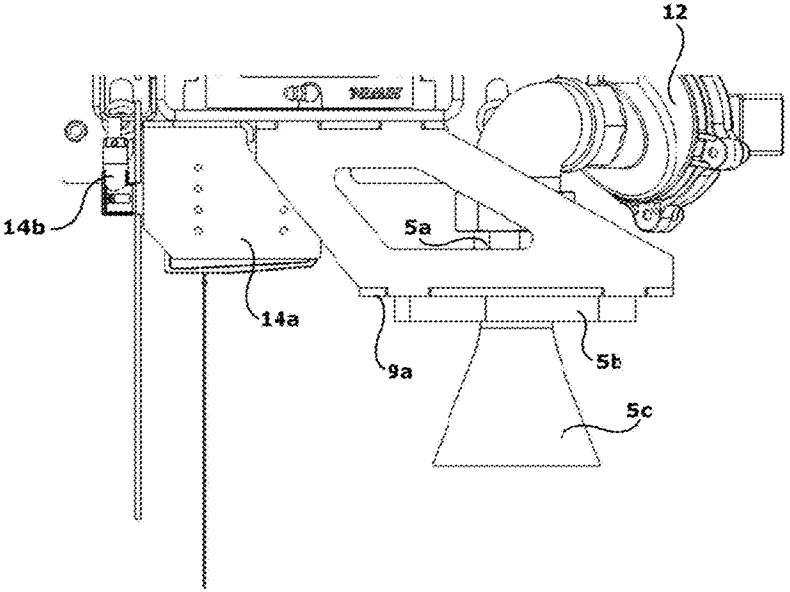
FIG. 5 is a plan view of a blowing nozzle of the detaching apparatus of FIG. 1.

Nozzle 5, as clearly illustrated in FIG. 5, comprises a connecting conduit 5*a* which extends, beyond a support flange 5*b*, into a divergent-convergent spout 5*c* (that is, with respect to a plane perpendicular to the flow of the nozzle, divergent in a first direction and convergent in the orthogonal direction) so as to change a circular cross-section of the connecting conduit 5*a* to an exit slit with a rectilinear-slit section. Divergent-convergent spout 5*c* can be obtained for example by squashing of a pipe with a circular section having a diameter equal to that of connecting conduit 5*a*.

The exit slit of divergent-convergent spout 5*c* terminates on a vertical plane, with a varying angle. Thereby, the dynamic pressure of the air flow coming out of spout 5*c* is directed mainly in a substantially horizontal direction, so as to meet the stack of metal sheets on the perimeter lateral edge thereof.

Nozzle 5 is mounted pivoting on the center line axis of the hole of plate 9*a* and is arranged in the desired angular position for example through a controllable electric motor (not shown) or simply through manual fastening means (not shown in detail) which engage with flange 5*b* and inside semicircular eyelets 9*b*, respectively.

An end of connecting conduit 5*a* is coupled with a connecting pipe 11, which in turn is connected to an outlet port of a servoassisted, fast-opening electrovalve 12. An inlet port of said fast-opening electrovalve 12 is instead connected to a second, large-diameter pipe 21, for example 1 inch diameter, which connects electrovalve 12 to a compressed-air tank 16 of a storage assembly 2.

Fast-opening electrovalve 12 is driven by an operating logic of the apparatus, to cause quick opening of the electrovalve when necessary (further details will be provided in the following) and to let an air stream of compressed air flow out from storage assembly 2 to nozzle 5, so as to effectively transform the pressurised air volume in storage assembly 2, into a dynamic pressure at the exit of nozzle 5. Said dynamic pressure results in an impact wave (burst) capable of determining an effective mechanical detachment effect on the metal sheets.

Moreover, next to support bracket 9, a first 14*a* and a second 14*b* detection unit are also mounted on moving column 4*b*, the first one at about the same height where nozzle 5 is arranged and the second one slightly lower.

The first detection unit 14*a* is a device suitable to detect the thickness of the metal sheets which are arranged in front thereof, for example it is an optical device capable of emitting an electromagnetic beam and of detecting the reflection thereof caused by the presence of the metal sheets. The detection direction of said detection unit 14 is transversal to the height on the lateral side of the stack of metal sheets.

The second detection unit 14*b* is designed to detect the height of the stack of metal sheets during the vertical movement of the assembly.

Figure 3:
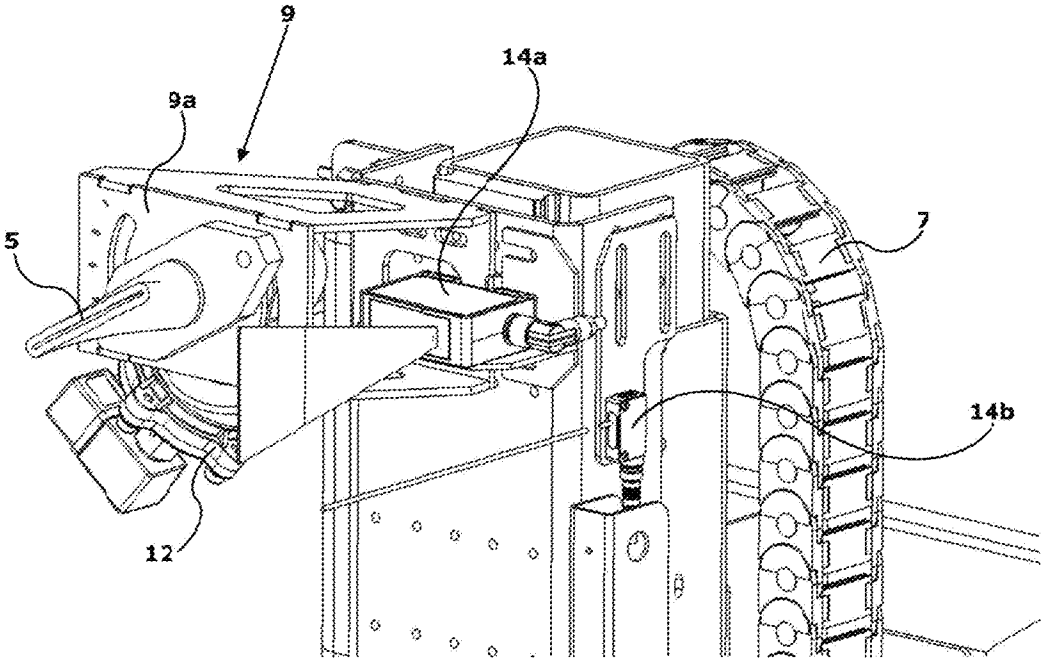
FIG. 3 is a partially enlarged perspective view of the upper part of the nozzle unit of the detaching apparatus of FIG. 1.
Figure 4B:
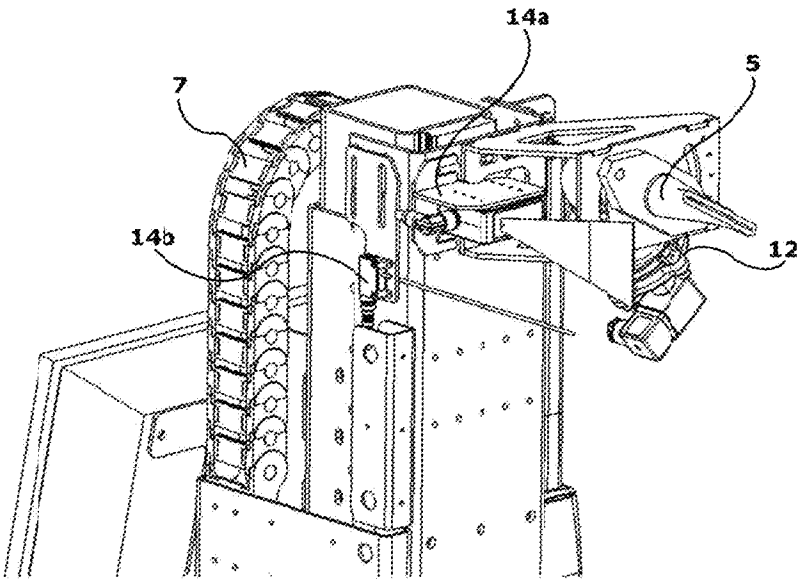
FIG. 4B is an enlarged perspective view of the upper part of the unit of FIG. 4A.
Figure 4A:
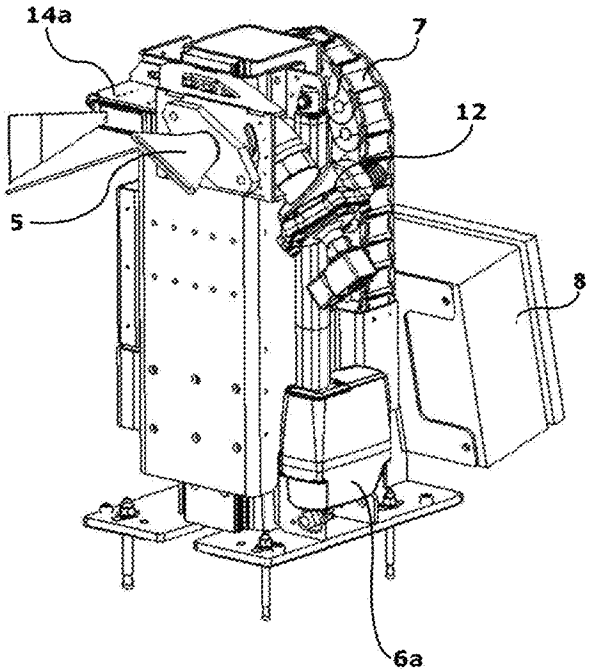
FIG. 4A is a perspective view similar to that of FIG. 1, of the nozzle unit according to an alternative embodiment.

In the embodiment represented in FIGS. 1-3 the two detection units 14*a* and 14*b* are mounted on the right-hand side of nozzle 5 (in the front view), while in the embodiment of FIGS. 4A and 4B the two units 14*a* and 14*b* are mounted on the opposite side.

As can be clearly understood, control panel 8, through wiring introduced into wire-guiding assembly 7, allows to control linear actuator 6, fast-opening electrovalve 12, detection units 14*a* and 14*b* and any rotary actuator of nozzle 5, in order to perform a fully automated process.

Moreover, control panel 8 includes a controlling device, for example with a programmable logic (PLC), meant to manage and control the various operating steps of the detaching apparatus in direct correlation with the operations carried out by an handling device or by other operating members during the drawing of the metal sheets.

Pressurised-air storage assembly 2 substantially comprises a tank 16, whereon a pressure multiplier 17 (booster), provided with a first pressure adjuster 18, and a second incoming pressure adjuster 19 at tank 16 are mounted.

As said, an outlet port of the storage assembly is connected to a pipe which connects to electrovalve 12. An inlet port to storage assembly 2, arranged upstream of the second pressure adjuster 19, is connected to a source of compressed air, typically available as distribution line of compressed air in industrial environments at about 6 bar.

In other words, the inlet port of the storage assembly 2 is connected to a standard air supply (not shown) through at least a pressure adjuster and pressure multiplier.

The volume of tank 16 is set according to the specific requirements. For reasons of cost and bulk, tank 16 can have a size varying between 20 lt and 80 lt, preferably between 25 and 45 lt.

According to the requirements of the stack of metal sheets to be processed, the energy to be used can vary. For such purpose, tank 16 can be loaded with a reduced air pressure, using the second incoming pressure adjuster, for example at a pressure of 4-6 bar. Usually the tank can be loaded with a higher pressure, using pressure multiplier 17 and the first pressure adjuster 18, for example up to a pressure of 12 bar.

In general, hence, storage assembly 2 is capable of supplying compressed air with a flow rate and a pressure suited to guarantee, downstream of nozzle 5, an air burst sufficient to detach the metal sheets each other.

In the operation of the detaching apparatus, it is initially provided to arrange nozzle unit 1 next to the stack of metal sheets, preferably in the proximity of a corner along the longer side of the sheet (see FIG. 6).

The tilting angle of the nozzle exit slit is set at the desired value, preferably at about 30° over horizontal. Thereby a wider vertical region of the sheet stack is covered and the impact wave of the air burst blow reaches a larger number of metal sheets.

The current thickness and height of the stack is detected through the first 14*a* and the second 14*b* detection unit 14 and support 4 is adjusted in height, so that the centreline of the exit slit of nozzle 5 is positioned at a preset height, corresponding to the separation plane (gap) between the metal sheet to be detached: thereby the maximum dynamic action of compressed air is in correspondence of the possible junction (gap) between a first and a second metal sheet of the stack (dynamic pressure is highest in the central area of the nozzle and decreases at the ends).

After that a preferred operating cycle is started which comprises also the coordination with an handling device.

With reference to FIG. 6, gripping heads T of the handling device pick up a metal sheet L on top of the stack and raise it to a preset height, until positioning it at the centreline of nozzle 5.

In this position metal sheet L is stopped and electrovalve 12 is opened with a time varying between 0.1 and 0.2 seconds (time settable through PLC). The impact wave generated by the air burst against the edge of metal sheet L detaches the other metal sheets which may have possibly remained adherent to and hanging from the upper metal sheet, so as to cause them to drop by gravity from a controlled height and position with respect to the stack.

Subsequently a measurement of the thickness of raised metal sheet L through detection unit 14*a* is performed: if the thickness measure was not consistent with the one expected for the individual metal sheet, the control system repeats the cycle a number of times (threshold) defined acceptable. Beyond such threshold the automatic cycle is stopped requesting operator action.

The controller logic can possibly change the pressure and/or tilting angle and height parameters of nozzle 5 before proceeding to a new blowing operation.

Alternatively, the controller, after the lifting action of gripping head T has stopped, can control an inverse release procedure of the metal sheet on the stack and cause the lifting and blowing cycle to be repeated again.

Once measurement made by detection unit 14*a* is consistent with the thickness of a single metal sheet, the cycle controller obtains the consensus to continue in the transfer of metal sheet L to the next station, for example to the incoming table in a laser cutting machine.

Based on the operating conditions (size and thickness of the metal sheets, height of the stack, tank 16 can be loaded at each cycle with a higher pressure (through pressure multiplier 17) or a lower pressure (through pressure adjuster 19) with respect to the incoming standard pressure of the standard compressed-air distribution line.

Since at each drawing of metal sheets the height of the metal sheet stack decreases, through the height indications detected by detection unit 14*b*, the position of the nozzle unit 5 is continuously adapted through the intervention of driver 6.

As can be clearly understood from the above-reported description, the burst detaching apparatus according to the present invention allows to perfectly reach the set objects.

As illustrated, the apparatus according to the present invention proves an optimal solution to make the drawing of sheets from sheet stacks effective. As a matter of fact, the apparatus allows to achieve a remarkable flexibility of use, both in determining the position and the tilting angle of nozzle 5, but also in determining the correct supply air pressure value.

The provision of a air storage tank and of the fast-opening electrovalve ensures an impulse air burst, which produces a very effective impact wave for obtaining the detachment of adhering metal sheets.

Moreover, the short high-pressure pipes (11, 21) between storage assembly 2 and nozzle unit 1 are easily shieldable, while a remaining compressed-air supply line (not shown) can also be extended, but does not imply particular safety problems because it has standard operating pressure in industrial environments.

However, it is understood that the invention must not be considered limited to the particular arrangements illustrated above, which represent only exemplifying embodiments thereof, but that different variants are possible, all within the reach of a person skilled in the field, without departing from the scope of protection of the invention, which is only defined by the following claims.

In particular, although the embodiments represented in the drawings provides a support base 3 fixed to the ground, it can be assumed that the nozzle assembly 1 and storage assembly 2 can be mounted onboard a moving structure, for example integral with a handling frame of the handling device. In such case, the height adjustment of support 4 can be provided as an option and it is not strictly necessary if it is provided to act only on the sheets raised off the stack through the same handling device.

Further, the above description makes reference to handling of metal sheets, but it is understood that the apparatus may be applicable also to handling of sheets of another nature and material.

The invention claimed is:

1. A detaching method of a stack of sheets, comprising the steps of:

providing an apparatus, equipped with at least a gripping head (T) of a sheet handling device, a nozzle assembly (1) configured to eject a substantially horizontal air flow toward a lateral edge of a stack of sheets, a detection unit (14*a*, 14*b*) of said sheets (L), and a pressurised-air storage assembly (2) provided with a tank of compressed air (16) that has a pressure multiplier (17) and a relative first pressure adjuster (18), an inlet port of the storage assembly (2) being connected to an air supply line upstream of the pressure multiplier (17), and a high-pressure pipe between the nozzle assembly (1) and the storage assembly (2) intercepted by a fast-opening electrovalve (12), the nozzle assembly including a moving support and a nozzle (5), the moving support provided with a height-adjustable column (4*b*) driven by an actuator (6), and the nozzle (5) mounted on the height-adjustable column (4*b*), the nozzle (5) supplied through the fast-opening electrovalve (12);

lifting a top sheet (L) of said stack of sheets through said gripping head (T) up until a preset height above the stack of sheets;

arranging said nozzle (5) at said preset height;

causing a burst of compressed air against a lateral edge of said top sheet (L) through said nozzle (5);

detecting a thickness of said top sheet (L) through said detection unit (14*a*) and determining if said thickness is consistent with an expected thickness for said top sheet (L); and if said detected thickness is not consistent, repeat again said step of causing a burst of compressed air.

2. The method as in claim 1, further comprising:

a preliminary step of detecting a height of said top sheet (L) on the stack of sheets by said detection unit (14*b*); and a height adjustment step of said nozzle (5) depending on the detected height of said top sheet (L).

3. A detaching method of a stack of sheets, comprising the steps of:

providing an apparatus, equipped with at least a gripping head (T) of a sheet handling device, a nozzle assembly (1) configured to eject a substantially horizontal air flow toward a lateral edge of a stack of sheets, a detection unit (14*a*, 14*b*) of said sheets (L), and a pressurised-air storage assembly (2) provided with a tank of compressed air (16) that has a pressure multiplier (17) and a relative first pressure adjuster (18), an inlet port of the storage assembly (2) being connected to an air supply line upstream of the pressure multiplier (17), and a high-pressure pipe between the nozzle assembly (1) and the storage assembly (2) intercepted by a fast-opening electrovalve (12), the nozzle assembly including a moving support and a nozzle (5), the moving support provided with a height-adjustable column (4*b*) driven by an actuator (6), and the nozzle (5) mounted on the height-adjustable column (4*b*), the nozzle (5) supplied through the fast-opening electrovalve (12), and the fast-opening electrovalve (12) mounted on said height-adjustable column (4*b*);

lifting a top sheet (L) of said stack of sheets through said gripping head (T) up until a preset height above the stack of sheets;

arranging said nozzle (5) at said preset height;

causing a burst of compressed air against a lateral edge of said top sheet (L) through said nozzle (5);

detecting a thickness of said top sheet (L) through said detection unit (14*a*) and determining if said thickness is consistent with an expected thickness for said top sheet (L); and if said detected thickness is not consistent, repeat again said step of causing a burst of compressed air.

* * * * *